US005575422A

United States Patent [19]

Peterman

[11] Patent Number: 5,575,422

[45] Date of Patent: Nov. 19, 1996

[54] EXTRUDED REINFORCED MAILBOX

[76] Inventor: Glenn Peterman, 118 Douglas Dr., Sandusky, Ohio 44870

[21] Appl. No.: 273,985

[22] Filed: Jul. 12, 1994

[51] Int. Cl.[6] ..... B65D 91/00

[52] U.S. Cl. ..... 232/38; 232/17

[58] Field of Search ..... 232/38, 17, 45

[56] References Cited

U.S. PATENT DOCUMENTS

| | | | |
|---|---|---|---|
| 745,749 | 12/1903 | Wheeler | 232/38 |
| 2,873,063 | 2/1959 | Cornell | 232/17 |
| 3,942,715 | 3/1976 | Anderson | 232/17 |
| 4,333,603 | 6/1982 | Carlson | 232/17 |
| 4,367,844 | 1/1983 | Drummond . | |
| 4,368,842 | 6/1983 | De Lange | 232/17 |
| 4,416,414 | 11/1983 | Edgerton | 232/17 |
| 4,611,651 | 9/1986 | Gourmel et al. . | |
| 4,627,566 | 12/1986 | Fibus . | |
| 4,775,000 | 10/1988 | Ayers . | |

FOREIGN PATENT DOCUMENTS

| | | | |
|---|---|---|---|
| 577292 | 7/1976 | Switzerland | 232/17 |

*Primary Examiner*—Flemming Saether
*Attorney, Agent, or Firm*—Jerry W. Semer

[57] ABSTRACT

The invention is an aluminum or plastic extruded vandal proof mailbox. In one embodiment mailboxes produced by the process of extruding aluminum or plastic through a mold that produces the body of the mailbox. Then attaching the back and the front door to the mailbox. In another embodiment the body is made in two pieces, the bottom piece and the top piece. The bottom and top are then attached together to form the body. Then the front and the back are attached to form the mailbox. In the preferred embodiment the bodies inter wall is reinforced by several reinforcement ribbons. This mailbox is made by the process of extruding aluminum or plastic through a mold that is designed to make the rib reinforcement in the body of the mailbox. Then reinforcement ribs on the end of the back and the front of the mailbox are router out a short distance and then the back and front of the mailbox are attached to the body.

14 Claims, 13 Drawing Sheets

EXTRUDED REINFORCED MAILBOX

FIELD OF INVENTION

This invention relates to a reinforced mailbox which vandals would have difficulty in destroying and more particularly to an extruded reinforced mailbox made by the process of extruding aluminum or plastic through a mold.

BACKGROUND OF THE INVENTION

Mailboxes which vandals would have a difficulty in destroying are usually made of extra heavy steel so vandal can not break in and steal the contents destroy the mailbox. These mailboxes in the vernacular are usually called "vandal proof" mailboxes. Since they are made of extra heavy steel these mailboxes are very heavy. This heaviness causes a problem that when the box which is normally mounted on the post and an automobile collide with the post the weight or inertia of the mailbox causes the mailbox to break free from the post and usually the mailbox goes through the automobile's front window and cause injury and sometimes death. Thus, the objective of the inventor is to lighten the mailbox which vandals would have a difficulty in damaging. Further, the manufacturer of a mailboxes out of steel take much bending and forming of steel. The bending and forming of steel for a which vandals would have difficulty in destroying mailbox which is made out of thicker steel then the average mailbox is even more expensive and time consuming to make. Thus, most mailboxes which vandals would have a difficulty in destroying sells for over a hundred dollars on the market. Therefore, one of the objectives of the inventor is to make a mailbox which vandals would have a difficulty in destroying that can be easily and cheaply manufacturer.

Mailboxes are continuously exposed to the environmental element and prone to rust and corrode. As a result of this corrosion and rusting the standard mailbox which vandals would have a difficulty in destroying may require quit frequent painting and repairs and also has a relatively short effective life. One of the objective of this invention is produce a mailbox that does not rust or corrode and will have many years of useful life. Most mailboxes have a flat floor upon which the mail is layed. Any dampness that gets into the mailbox collects on the floor of the mailbox and the mail laying on the floor of the mailbox would be damp. One of the objective of this invention is to create a mailbox which holds the mail slightly off the floor to protect the mail from dampness.

The main feature that allows the mailbox to be lighter and less expensive and easier to manufacturer then the mailboxes which vandals would have a difficulty in destroying now on the market is that the mailbox's main body is extruded from aluminum or plastic. Also the floor of the mailbox has ribs to hold the letters off the floor. By being able to extrude the mailbox out of aluminum one can make a lighter vandal proof mailbox that is also cheaper and easier to manufacturer. The ribs hold the letters off the floor and thus the letters will not become damp from dampness collecting on the floor in the mailbox.

SUMMARY OF THE INVENTORY

The invention is an aluminum or plastic extruded mailbox which vandals would have difficulty in destroying. In one embodiment the mailbox is produced by the process of extruding aluminum or plastic through a mold to produces the body of the mailbox. Then the back and the front door are attached to the mailbox. In another embodiment the body is made in two pieces, the bottom piece and the top piece. The bottom and top are then attached together to form the body. Then the front and the back are attached to form the mailbox. In the preferred embodiment the body's inter wall is reinforced by several reinforcement ribbons. This mailbox is made by the process of extruding aluminum or plastic through a mold that is designed to make the ribbon reinforcement in the body of the mailbox. Then reinforcement ribbons on the end of the back and the front of the mailbox are ground out by a router a short distance and then the back and front of the mailbox are attached to the body.

BRIEF DESCRIPTION OF THE DRAWINGS

FIG. 3 is a front view of the mold that the mailbox body is extruded through.

FIG. 4*a* is a front view of the mold that the bottom of the mailbox body is extruded through.

DETAILED DESCRIPTION OF THE PREFERRED EMBODIMENT

Figure 1:
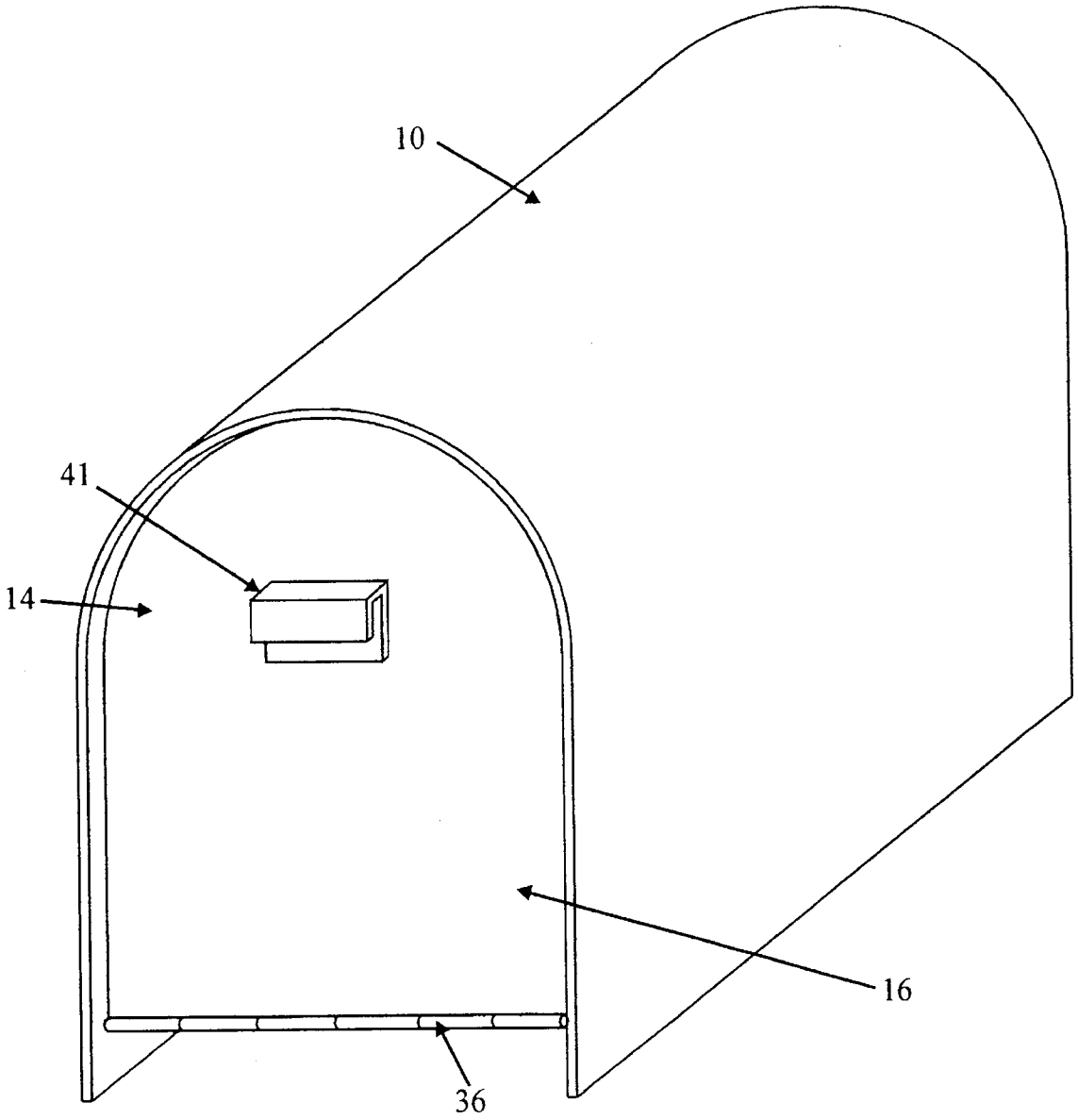
FIG. 1 is a perspective view of the front of the mailbox.
Figure 2:
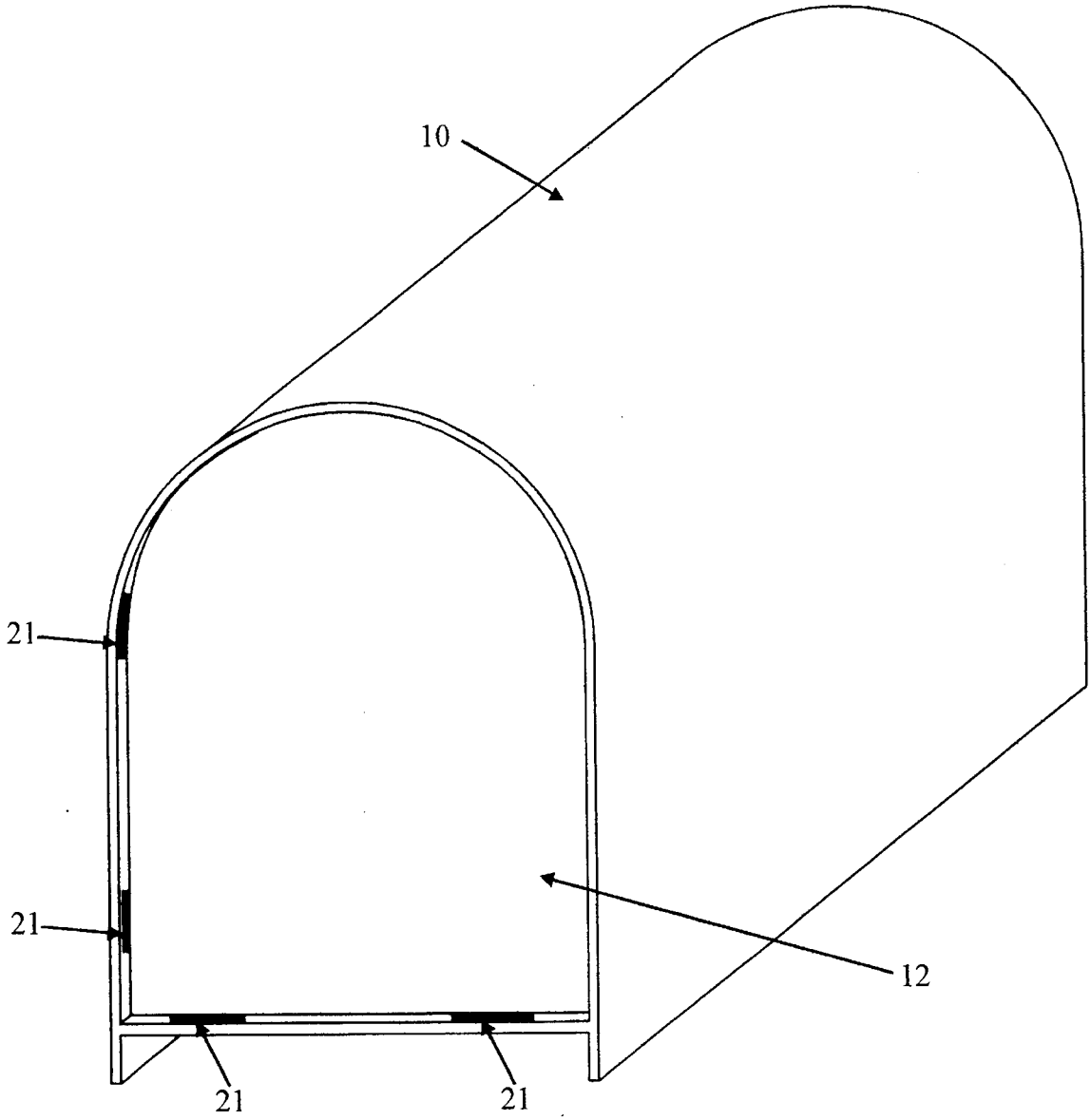
FIG. 2 is a perspective view of the back of the mailbox.
Figure 3:
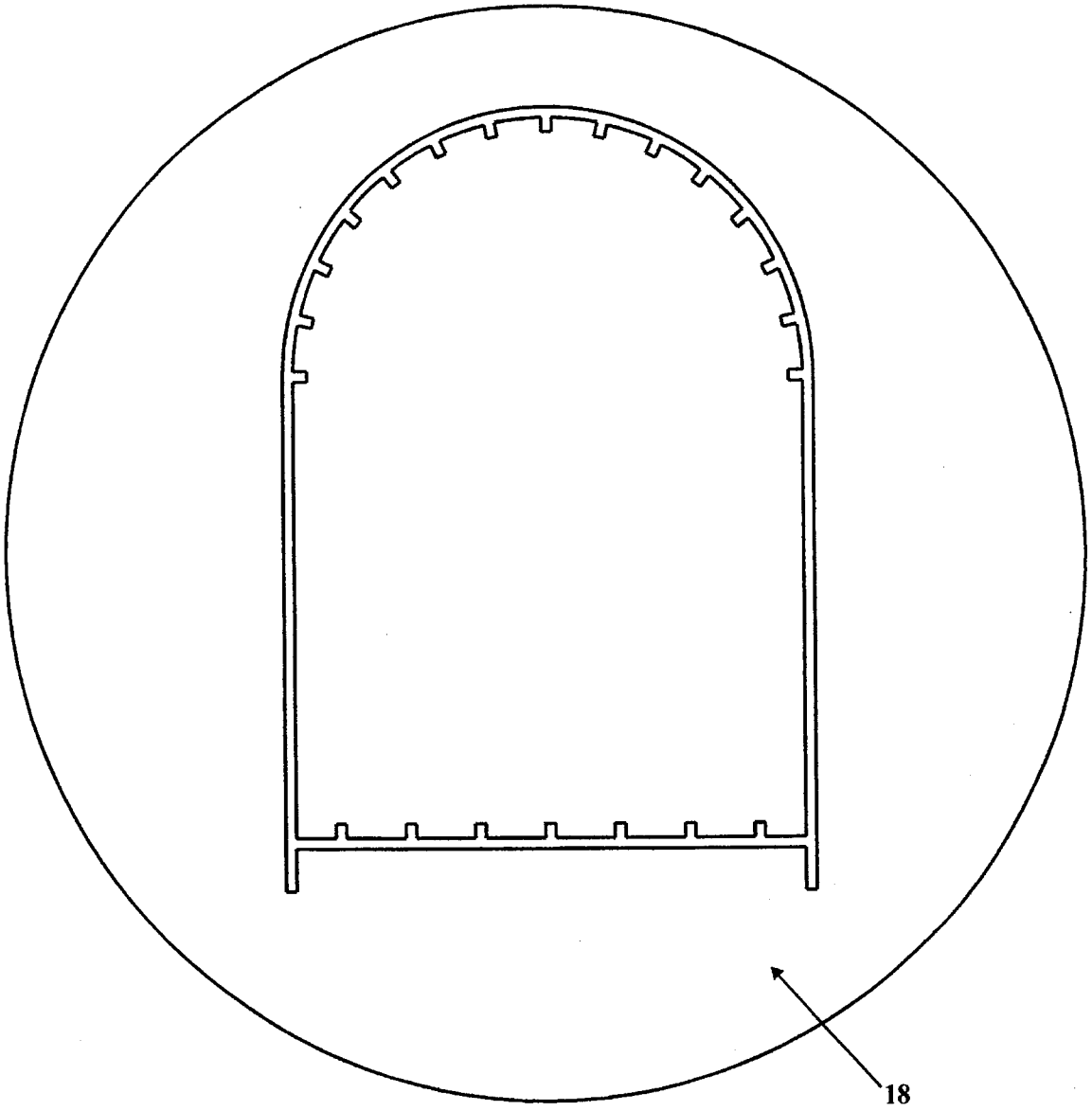
Figure 4A:
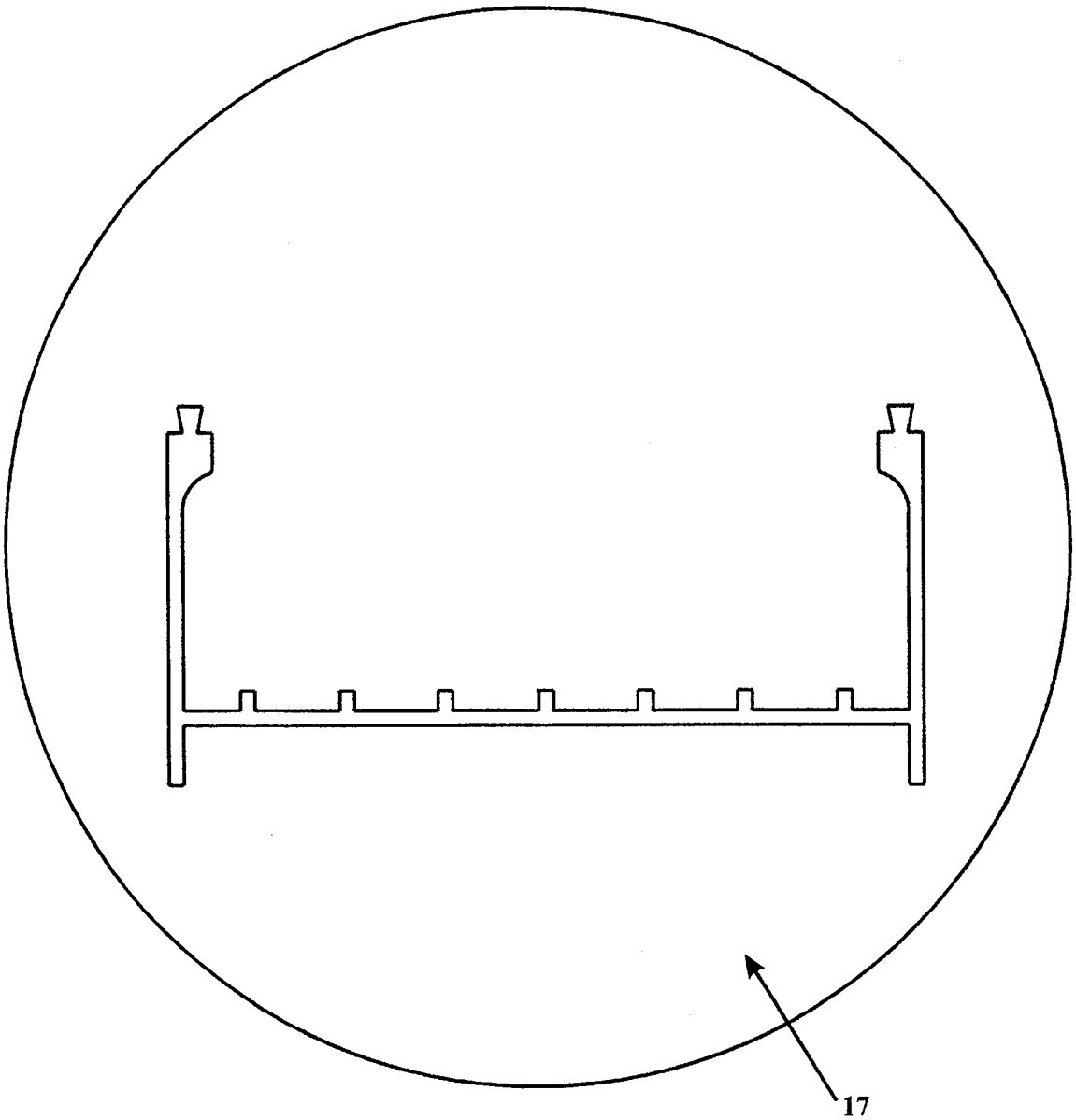
Figure 4B:
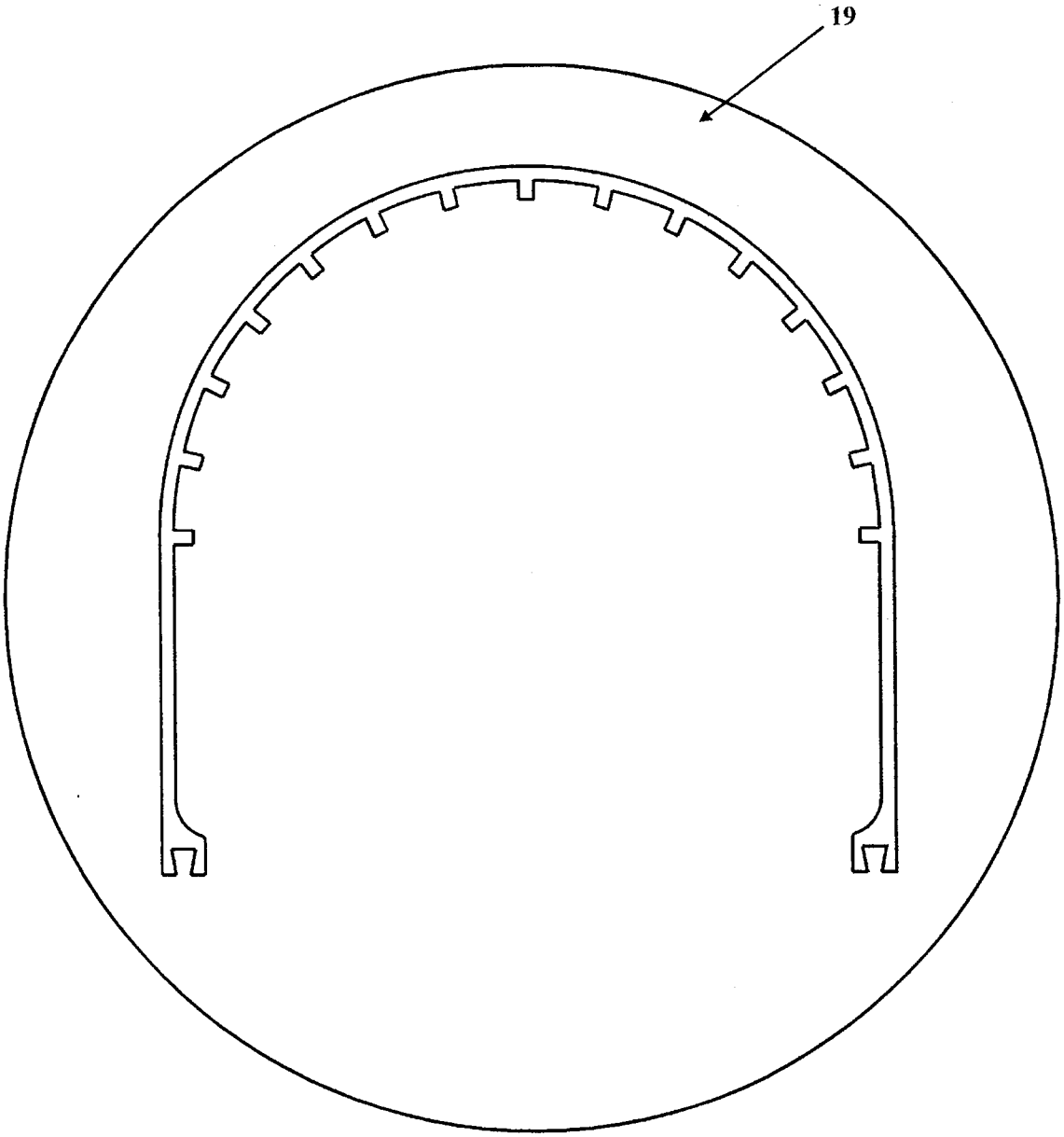
FIG. 4*b* is a front view of the mold that the top of the mailbox body is extruded through for the bottom of FIG. 4*a*.
Figure 5:
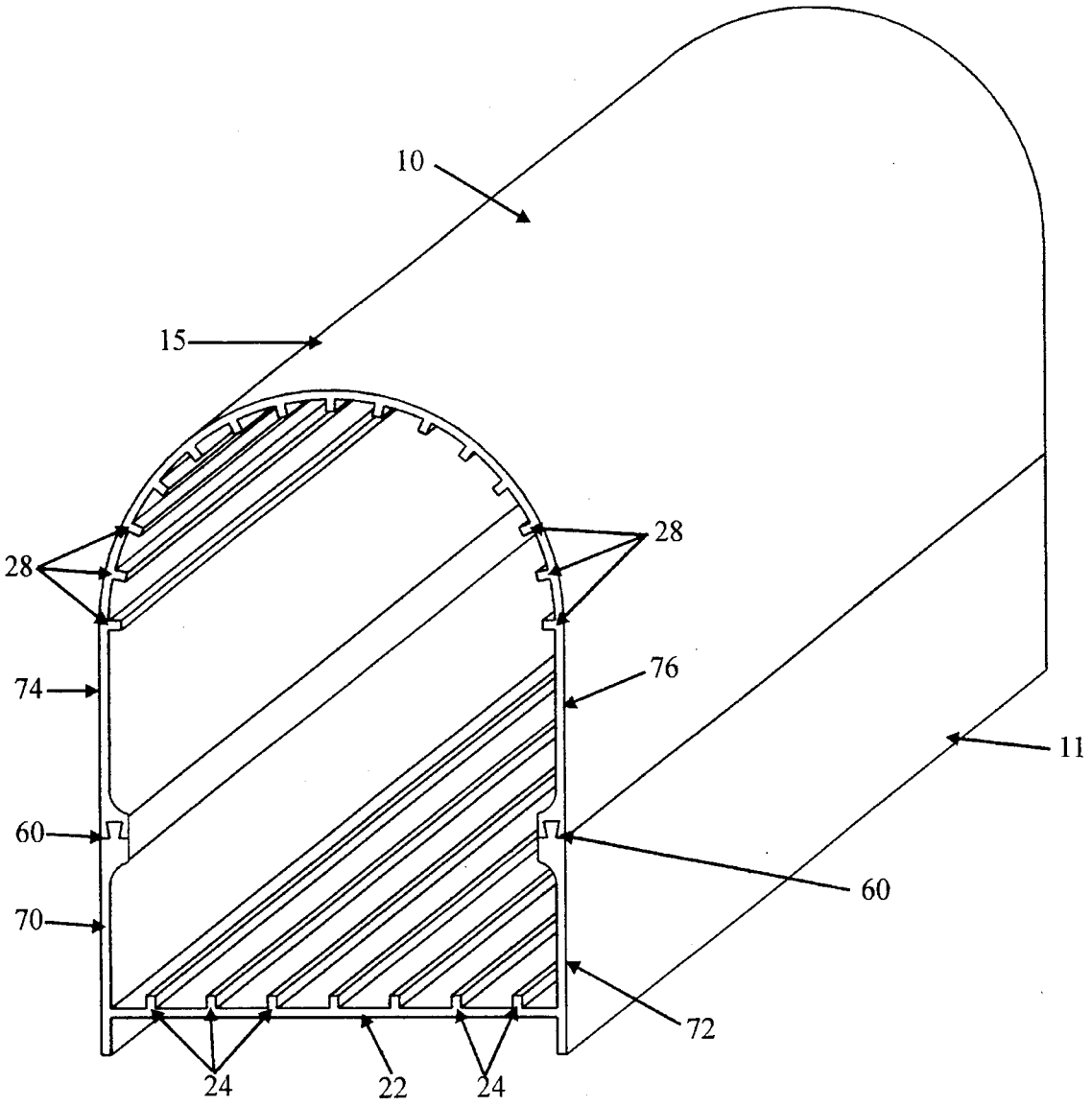
FIG. 5 is a perspective view of the two piece body.
Figure 11A:
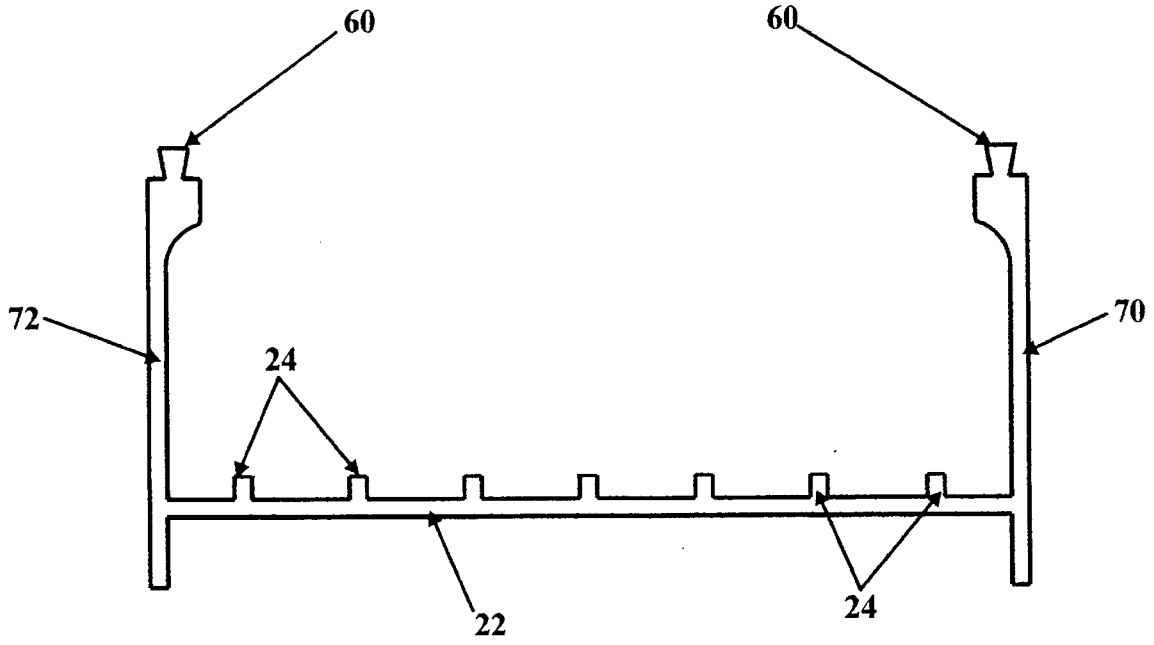
FIG. 11*a* is the front view of the bottom of the two piece body.
Figure 11B:
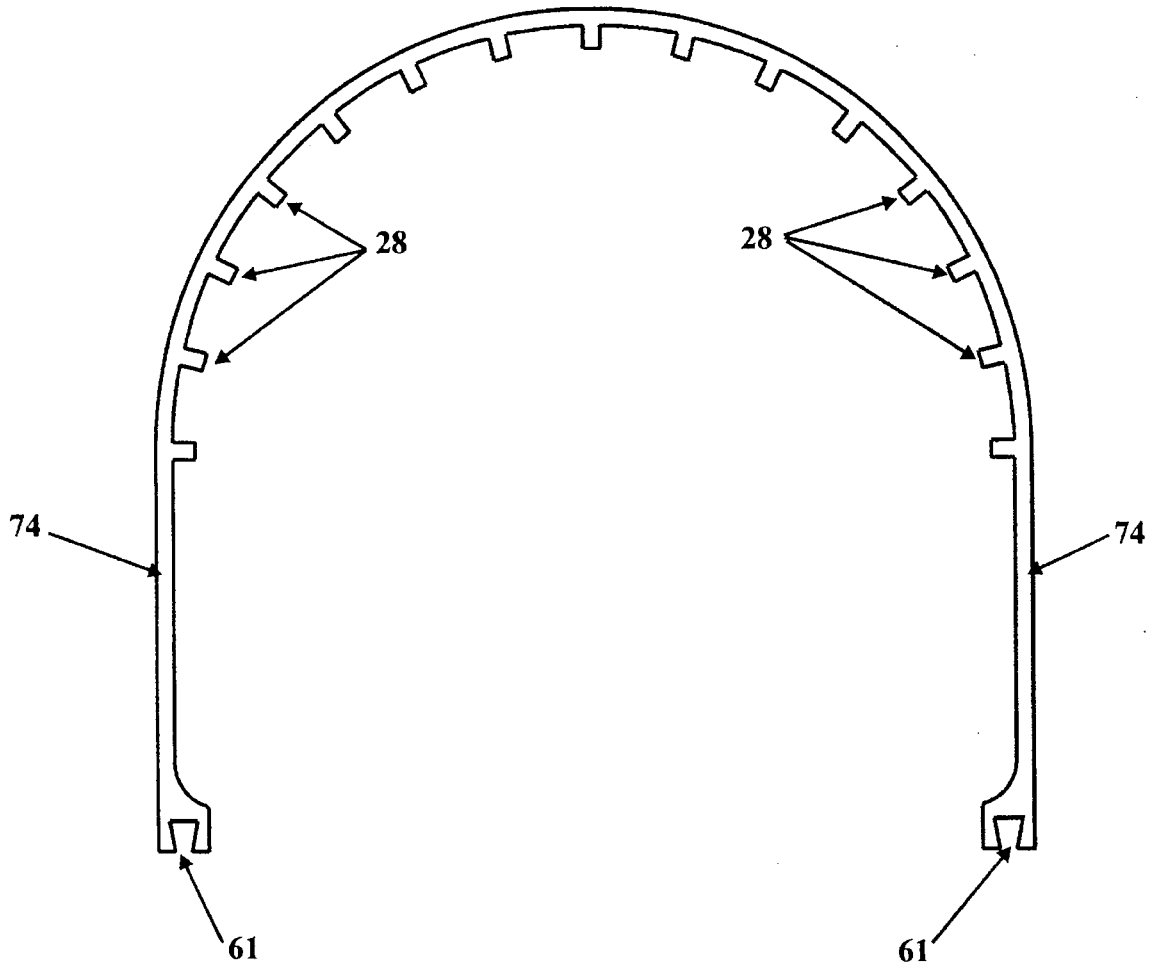
FIG. 11*b* is a front view of the top of the two piece body.

FIGS. 1 and 2 show a perspective view of the mailbox. FIG. 1 shows the body 10 and the front 14 with a door 16. FIG. 2 shows the back perspective view of the mailbox with body 10 and back wall 12. Body 10 is formed by extruding aluminum or plastic through the molds shown in FIGS. 3 or 4*a* and *b*. The body 10 can be made in one or two pieces. Mold 18 shown in FIG. 3 is the mold for the one piece body 10. FIGS. 4*a* and 4*b* show the molds for the two piece body 10. FIG. 4*a* shows the mode 17 for the bottom 11 of the body 10 and FIG. 4*b* shows the mode 19 for the top 15 of the body 10. In the preferred embodiment for the two piece body the bottom of the body is attached to the top of the body by sliding the bottom of the body into a grove in the top of the body. FIG. 5 shows a perspective view of the whole body 10 for the two piece body. FIGS. 11*a* and 5 shows that the bottom 11 of the body 10 has a tongue 60 on the top of each side 70 and 72. These tongues 60 slid into a groves 61 on the bottom of sides 74 and 76 of the top 15 of the body 10 as shown in FIGS. 11*b* and 5. To hold the body 10 more firmly together these two pieces are either glued or welded together. There are many ways known in the art to attached these two pieces together. Clearly the bottom 11 and the top 15 could be attached using different shaped openings that slide together.

The aluminum or plastic is extruded through the mold 18 or 17 and 19 and allowed to cool or harden and is then cut into lengths for the mailbox. The aluminum or plastic could also be extruded, then cut and then allowed to cool or harden. FIG. 5 shows that the floor 22 of the body 10 has ribs 24 running along its length. These ribs 24 are designed to hold a envelope off the floor 22 of the mailbox so that if dampness or water seeps into the mailbox the letters will be held off the floor 22 and will not get damp. FIG. 5 also shows reinforcement ribbons 28 running along the length of the top of the body 10. These reinforcement ribbons 28 run along the inner side walls and top arch of the mailbox and adds strength to the aluminum or plastic mailbox. Since the mailbox is designed to be difficult to destroy by vandals, these reinforcement ribbons 28 allow the mailbox to take blows from baseball bats without damage.

Figure 6:
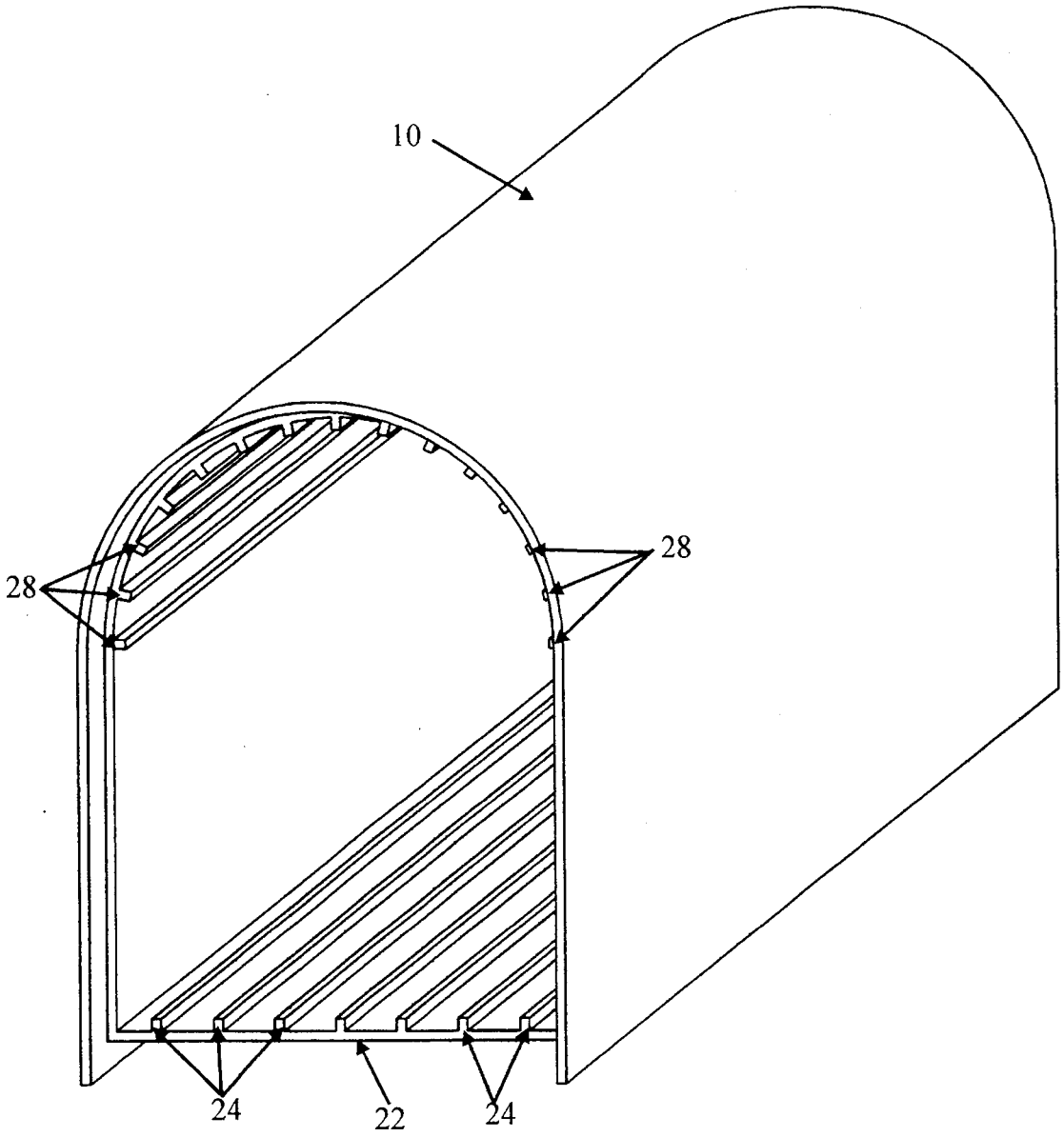
FIG. 6 is a perspective view of the one piece body of the mailbox after the ribs and floor have been router out.

FIG. 5 is a view of the body 10 of the mailbox as it comes out of the extrusion. FIG. 6 perspectives view of the body 10 of the mailbox is after the reinforcement ribbons 28 and the bottom of the body 10 have been cut or filed out at the end of the mailbox. The reinforcement ribbons 28 and the bottom of the body 10 at both ends of the mailbox are grounded out by a router so that the front 14 and the back 12 of the mailbox can be attached. In the preferred embodiment the bottom 11 of the body 10 and the reinforcement ribs 28 are ground out by bringing the router or grinder up from the bottom and taking out approximately half the wall plus the bottom 11 plus the reinforcement ribbons 28. The results is shown in FIG. 6. The body 10 is router out on both ends a sufficient distance that the back 12 and the front 14 can be attached.

Figure 7:
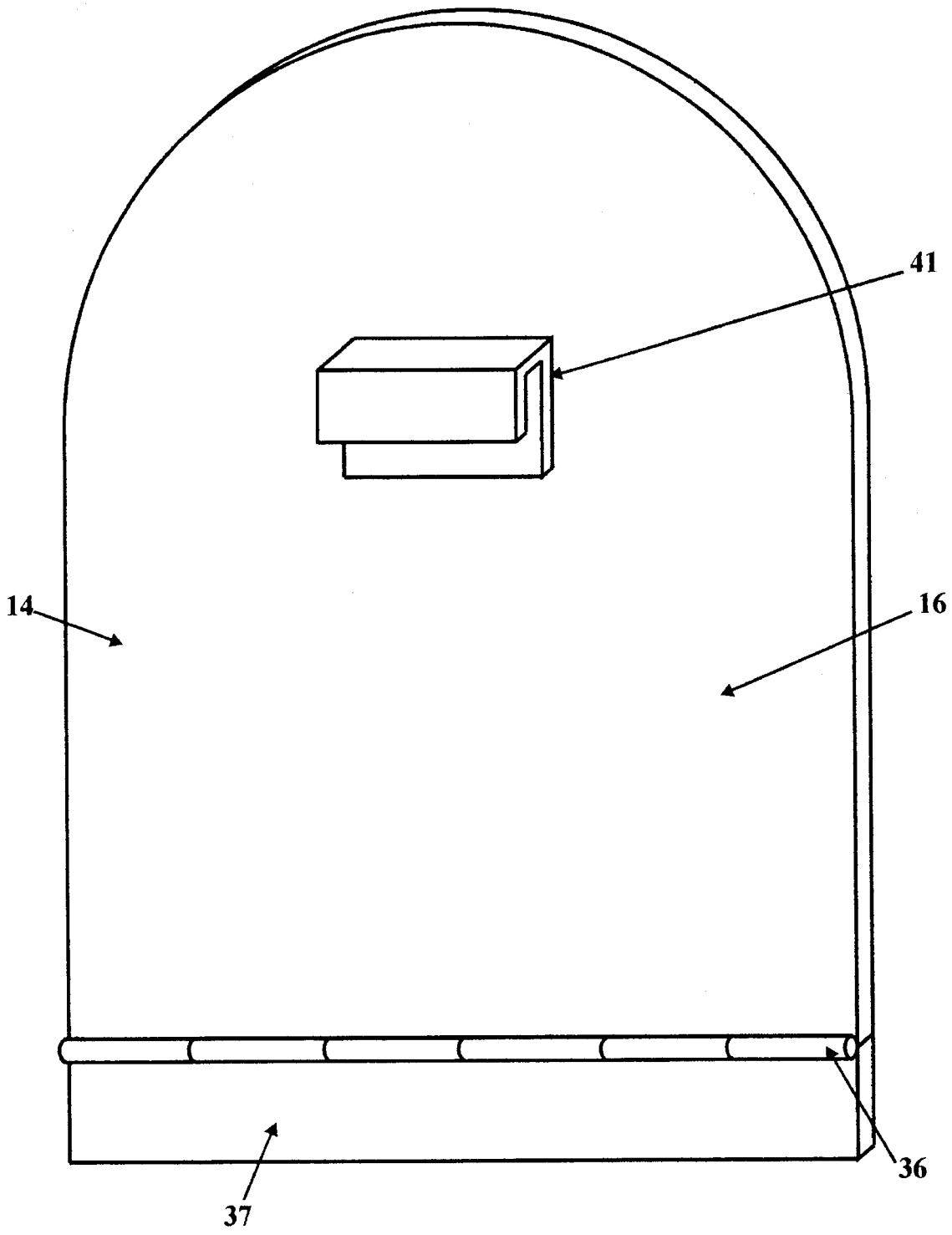
FIG. 7 is a front view of the front of the mailbox.
Figure 8:
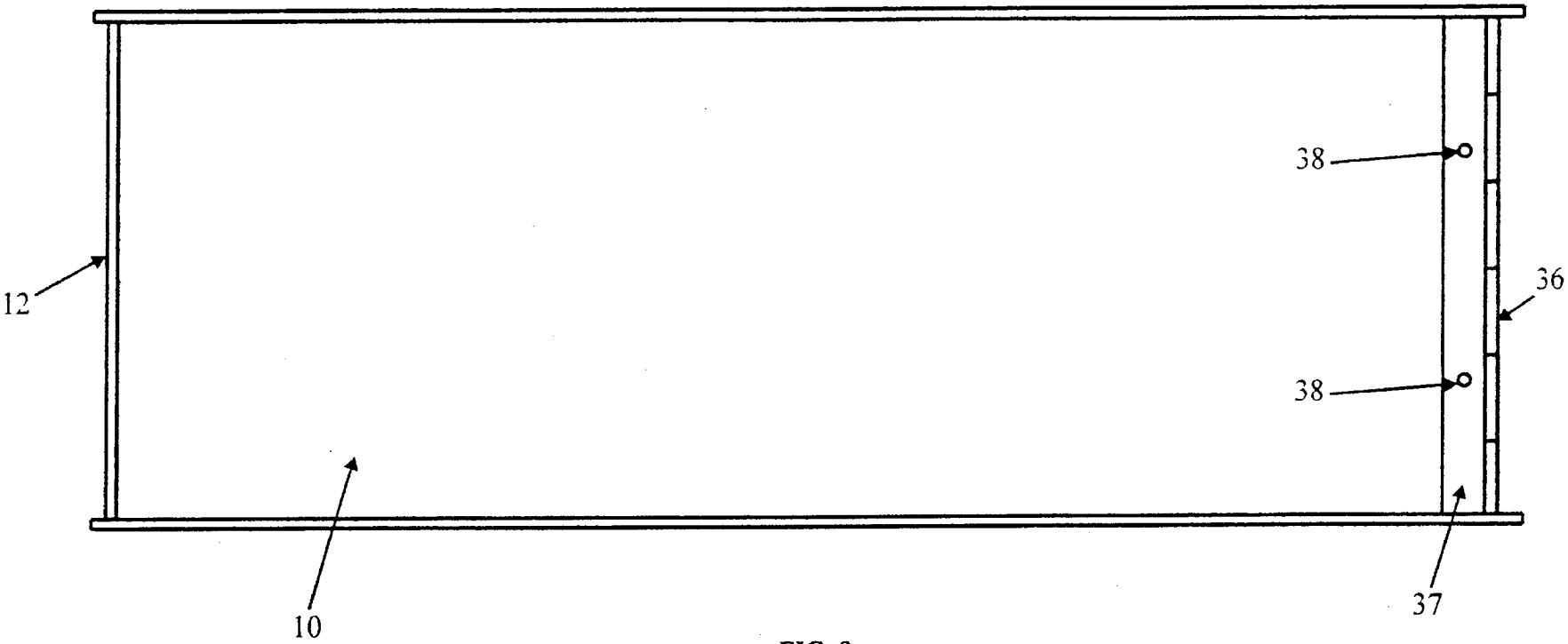
FIG. 8 is a bottom view of the mailbox.

FIG. 2 shows the back 12 of the mailbox that is attached by sliding the back 12 into the rear of body 10. In the preferred embodiment which is made of aluminum the back 12 and the body are then welded together. Welds 21 are shown in FIG. 2. The back 12 could also be attached in many ways known in the art such as gluing back 12 in place. In the embodiment made of plastic the back 12 is glued to the body 10. The back 12 could also be attached by welding and other method known in the art. The front 14 shown in FIG. 7 is inserted in the same way as back 12. In the preferred embodiment which is made of aluminum front 14 has at the bottom hinge 36. In the preferred embodiment the front 14 is slid into the body 10 and the bottom of hinge 36 is turned upward and pins 38 are driven through the bottom 37 of hinge 36 and through the bottom 22 of body 10 to hold the front 14 in place as shown in FIG. 8. Front 14 could also be welded or glued in place. In the embodiment made of plastic the front 14 is glued to the body 10. Just as the back 12, the front 14 can be attached in many other ways known in the art.

Figure 9:
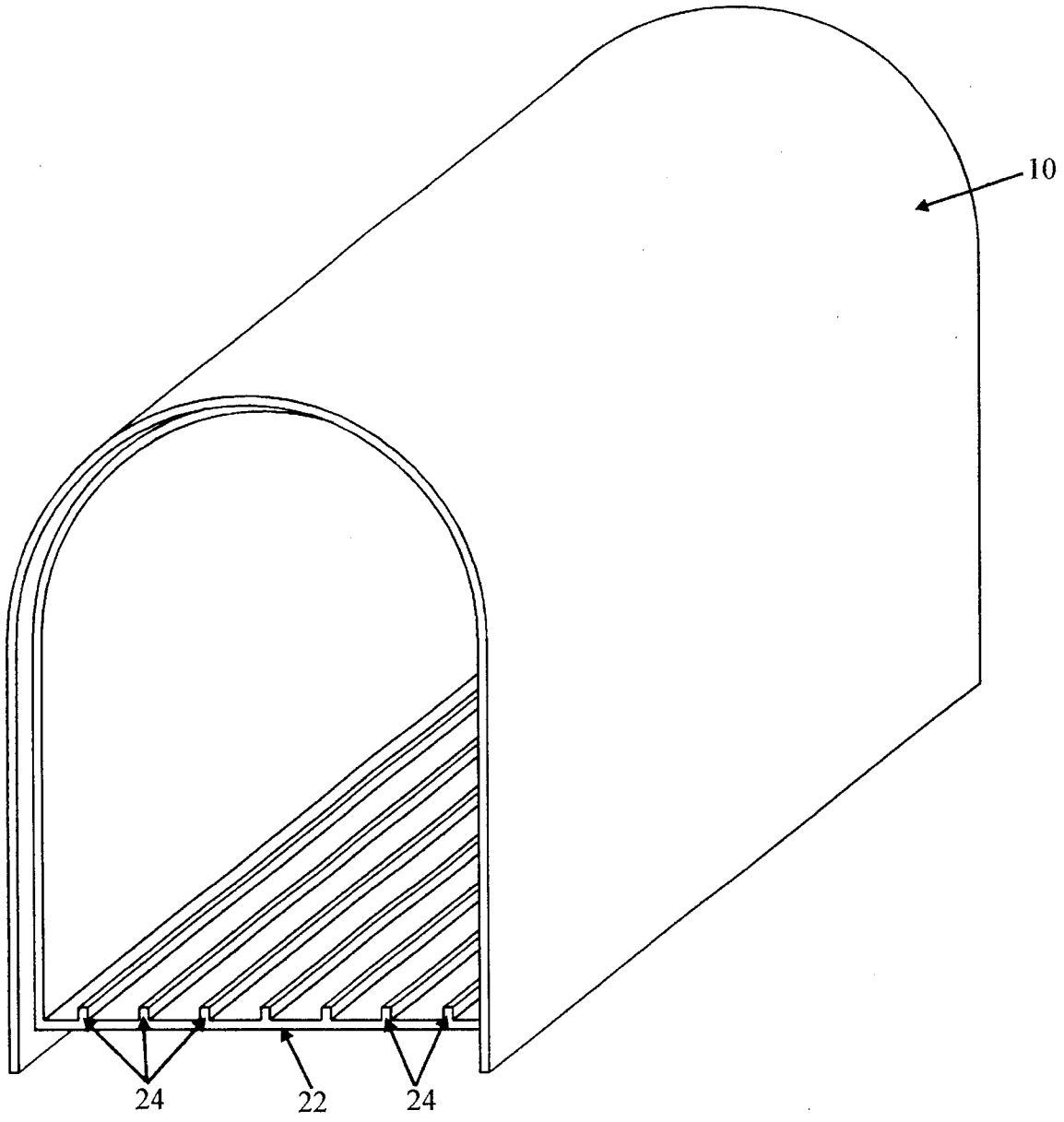
FIG. 9 is a perspective view of the body of one embodiment of the mailbox after the floor is router out.

One of the embodiment as shown in FIG. 9 the body 10 does not have reinforcement ribbons. In this embodiment the body 10 is made sufficiently strong by making the walls of the body thicker. In this embodiment the body does not have to be router out. After the body 10 is formed then the front 14 and back 12 are placed on the body 10. The front 14 and the back 12 are attached as put forth above except for the step of grinding out the reinforcement ribbons. In this embodiment the back 12 and front 14 can be attached by gluing, welding, pins, or other methods known in the art. In another embodiment the back and front are shaped so that they will fit over the reinforcement ribs. Again as in the previous embodiment the back and front are attached by welding, gluing, or pins or other methods known in the art.

In the preferred embodiment made out of aluminum, the back 12 is stamped out of aluminum. There are many other ways in which back 12 can be made including molding. In the embodiment made out of plastic the back 12 is molded or stamped. Front 14 is also stamped out of aluminum in the preferred embodiment. In the plastic embodiment the front is molded or stamped. There are clearly numerous ways known in the art to make the back 12 and front 14. The front 14 is basically a door 30 and a hinge 36. Hinge 36 is attached to the bottom of the body 10 by a set of pins 40. The hinge 36 could also be attached to the door by gluing or welding. In the preferred embodiment the hinge 36 is made out of stainless steel. In the plastic embodiment the hinge 36 is made out of plastic.

Figure 10:
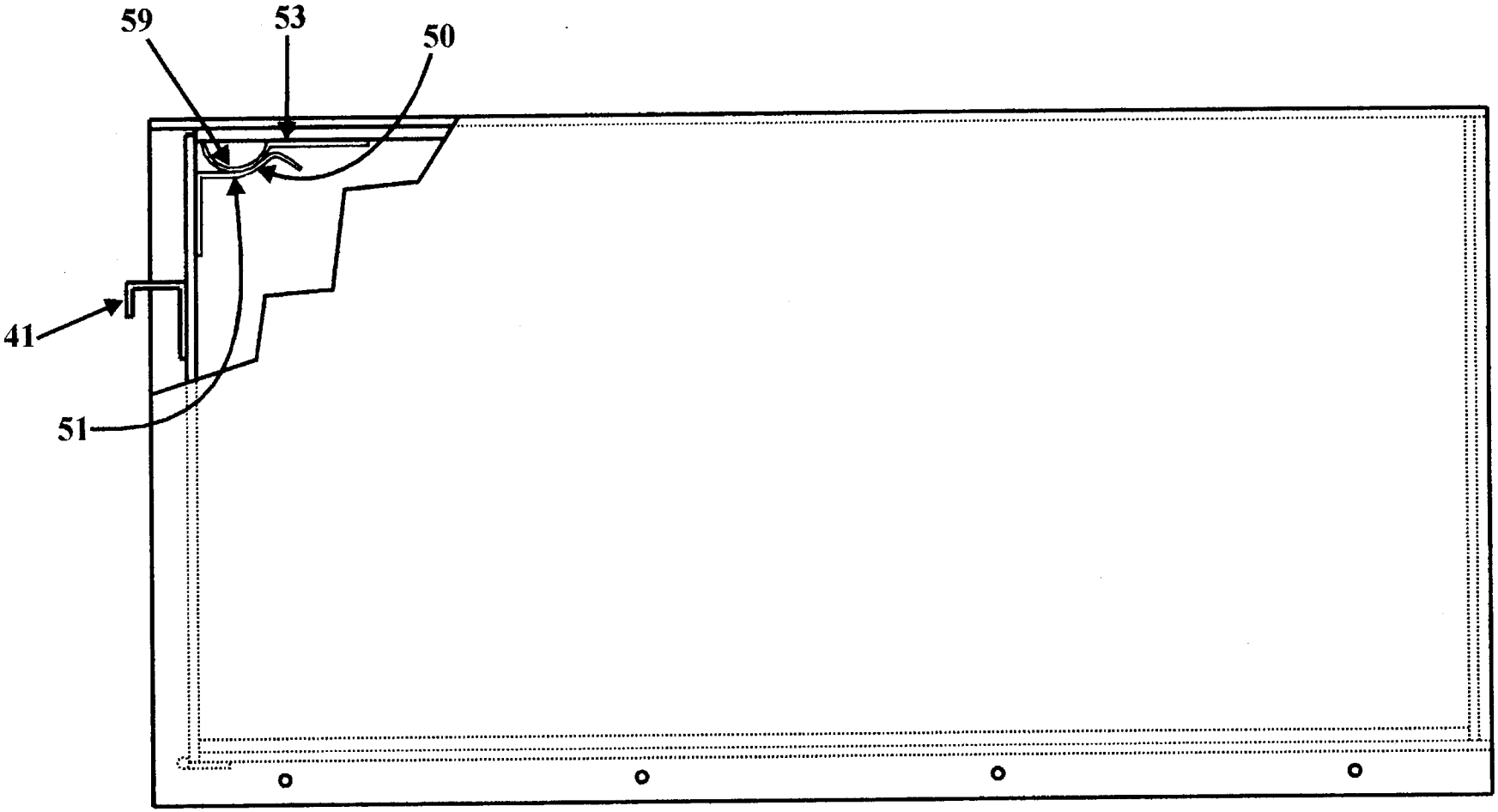
FIG. 10 is a partial cut away view of a side view of the mailbox showing the locking assembly in the cutaway.

The lock assembly 50 holds the door 16 in a closed or up position as in FIG. 1. For the person to gain access to the mail box one must open door 16 which means that door 16 must be disengaged from locking assembly 50. The locking assembly 50 made out of two pieces 53 and 57 as shown in FIG. 10. The door piece is an L-shape piece 57 attached to the inside of the door 16 at the top of the door 16. The L-shape piece 57 extends outward from the door 16 and upward at its end. The body piece 53 extends downward from the top of the body 10 and at its end 59 is shaped in a V. As shown by FIG. 10 when the door is closed the L-shape door piece 57 is adapted such that the L fits behind the V-shape end 59 of the body piece 53 and holds the door securely shut. To open the door an individual pulls the handle 41 on the door 16 forward. The L-shape piece 57 then moves forward along the V forcing the body piece 53 upward until the L-shape piece passes 57 under the V-shape end 59 freeing the door 16 to be open. To close the door 16, the door 16 is pushed shut and the L-shape piece 57 hits the V-shape end 59 and forces the body piece 53 upward until the L-shape again passes under the bottom of the V. When the L-shape piece 57 passes under the bottom of the V, the body piece 53 springs back into its original position and holds the door securely in place. In another embodiment of the invention, the locking assembly is made of two pieces. In the preferred embodiment both pieces are made of aluminum. The door piece is attached to the door. It extends perpendicularly and outward from the top of the front of the door. As the door piece extends outward from the door it has a convex section and then extends downward. The body piece is attached to the top of the body. The body piece extends vertically from the body and at its ends extends upward. The body piece also has a convex portion. The body convex section is adapted to fit within the door piece such that the door is held fully closed. To open one pulls down on the bottom piece to disengaged the bottom piece from the top piece.

Since the body 10, the back 12 and the front 14, and the locking assembly 50 of the box are made out of aluminum or plastic and the hinge 36 on the door 16 is stainless steel or plastic, the mailbox is completely rust proof and thus eliminates one of the main problems with steel mailboxes.

Changes and modifications in the specifically described embodiments can be carried out without departing from the scope of the invention which is intended to be limited only by the scope of the appended claims.

I claim:

1. A reinforced mailbox produced by the method comprising of the steps of:

a. extruding a body of the mailbox and said body has a flat bottom and a top and said body has a means for reinforcing the mailbox, said reinforcing means including ribbons on an inside surface of the top of the mailbox such that there will be no damages caused by an individual striking said mailbox with a baseball bat; and, b. attaching a back wall to the extruded body; and, c. attaching a front door to the extruded body.

2. A mailbox as in claim 1 wherein:

a. a hinge that is attached to an end of the extruded body; and, b. the door attached to said hinge; and, c. a means for holding the door in a closed position attached to the mailbox.

3. A mailbox as in claim 1 wherein:

a. the body, the back wall and the front door are made from aluminum.

4. A mailbox as in claim 1 wherein:

a. the floor has ribs to hold letters placed in the mailbox off the floor.

5. A mailbox as in claim 1 further comprising:

a. the step of grinding out the reinforcement ribbons and the floor at a back end and front end of the body to create an opening for the attachment of the back wall and front door.

6. A mailbox as in claim 1 wherein:

a. the body is made out of aluminum.

7. A mailbox as in claim 1 wherein:

a. the body is made out of plastic.

8. A reinforced mailbox comprising:

a. a body which is a tube with two open ends and an inside and an outside with a flat bottom and a rounded top with ribbons for reinforcement along the top inside surface of the tube; and, a back wall attached to one open end of the tube c a front door attached to the other open end of the tube such that when the door is open a person can assess items within the tube.

9: A mailbox as in claim 8 wherein:

a. the body is made out of aluminum.

10. A mailbox as in claim 8 wherein:

a. the floor has ribs to hold letters placed in the mailbox off the floor.

11. A mailbox as in claim 8 wherein:

a. the body is made out of plastic.

12. A mailbox produced by the method comprising of the steps of:

a. extruding a first piece of the mailbox; and, b. extruding a second piece of the mailbox; and, c. attaching the first piece to the second piece to form a body of the mailbox which is a tube with a back and front open end and an inside and outside and a flat bottom and said tube has a means for reinforcing the mailbox, said reinforcing means including ribbons on a top inside surface of the mailbox such that there will be no damages caused by an individual striking said mailbox with a baseball bat; and, d. attaching a front door to the extruded body; and, e. attaching a back wall to the extruded body.

13. A mailbox as in claim 12 wherein:

a. the floor has ribs to hold letters placed in the mailbox off the floor.

14. A mailbox as in claim 12 further comprising:

a. grinding out the ribbons and the floor at the back end and front end of the body to create an opening for attaching the back wall and front door.

* * * * *